United States Patent [19]

Jones et al.

[11] Patent Number: 4,770,205

[45] Date of Patent: Sep. 13, 1988

[54] BI-DIRECTIONAL SNUB VALVE

[75] Inventors: Teddy L. Jones; Gary D. Gillingham, both of Cherry Valley, Ill.; Jonathan E. Beimborn, Janesville, Wis.

[73] Assignee: Sundstrand Corporation, Rockford, Ill.

[21] Appl. No.: 46,472

[22] Filed: May 4, 1987

[51] Int. Cl.[4] ..... F15B 13/04

[52] U.S. Cl. ..... 137/493.8; 91/397

[58] Field of Search ..... 137/493, 493.8; 91/397

[56] References Cited

U.S. PATENT DOCUMENTS

| | | | |
|---|---|---|---|
| 519,639 | 5/1894 | Matthews | 91/397 |
| 1,033,181 | 7/1912 | Larsson | 91/397 |
| 1,132,203 | 3/1915 | Matthews | 91/397 X |
| 3,001,511 | 9/1961 | Poyner | 91/397 X |
| 3,216,446 | 11/1965 | Schmiel . | |
| 3,319,653 | 5/1967 | Stephens . | |
| 3,489,172 | 1/1970 | Whitmore | 137/493.8 X |
| 3,661,422 | 5/1972 | Sember . | |
| 3,866,627 | 2/1975 | Dezelan . | |

*Primary Examiner*—Robert G. Nilson

*Attorney, Agent, or Firm*—William D. Lanyi

[57] ABSTRACT

A bi-directional snub valve provides two parallel fluid paths therethrough and means for restricting the fluid flow through each of the parallel paths to one preferred direction. A movable piston is provided with two land portions which selectively are movable into blocking association with two openings in a fluid chamber. Blockage of either of the two openings in the fluid chamber and the corresponding fluid flow path does not effect the ability of the alternate path to conduct a fluid therethrough. The bi-directional snub valve therefore is able to slow the flow of fluid therethrough as a movable object approaches its end-of-travel position. However, because of the nature of the two parallel flow paths, the movable object can be moved away from its end-of-travel position at full speed. A cam arrangement is used to move the piston of the snub valve in response to movement of the movable object.

24 Claims, 4 Drawing Sheets

BI-DIRECTIONAL SNUB VALVE

BACKGROUND OF THE INVENTION

1. Field of the Invention

The present invention relates generally to a snub valve and, more particularly, to a snub valve for a hydraulic system which provides a progressively reduced flow of fluid through the valve in response to the movement of a movable object toward a predetermined end-of-travel position.

2. Description of the prior art

In systems which use hydraulic power to move a movable object, such as a flight control surface of an airplane, a door or other device which is moved in response to the flow of a motive fluid, it is advantageous to provide a means for slowing the rate of movement of the movable object as it approaches its end-of-travel position. For example, if a flight control surface is moved by hydraulic power from a fully opened position to a fully closed position, the flight control surface may possibly be damaged if it is permitted to move at full speed against a mechanical stop at its end-of-travel position.

Various types of flow control valves are known to those skilled in the art. For example, U.S. Pat. No. 3,319,653, which issued to Stephens on May 16, 1967, discloses a flow control valve with a spool valve portion which incorporates an integrally housed anticavitation valve and a load check valve within the body of the flow control valve. This valve provides a means by which the return oil from the working cylinder is fed into the pump flow when negative pump pressure is indicated by the loading of a work cylinder.

U.S. Pat. No. 3,216,446, which issued to Schmiel on Nov. 9, 1965, discloses a spool valve assembly with dual check valves. The check valves in this device are arranged to prevent back flow of fluid from a motor port to the pressure inlet port of the spool valve housing and to permit flow of fluid from a tank port to a motor port. The purpose of this arrangement is to prevent load dropping and cavitation of a fluid motor that is controlled by the spool valve assembly.

U.S. Pat. No. 3,866,627, which issued to Dezelan on Feb. 18, 1975, discloses a dual check valve arrangement in which a first check valve is positioned between a pump and a selector valve to pass pressurized hydraulic fluid thereby and a second check valve that is mounted telescopically within the first check valve. The second check valve is opened when the fluid pressure in the reservoir exceeds a predetermined magnitude.

U.S. Pat. No. 3,661,422, which issued to Sember et al on May 9, 1972, discloses an adjustment valve for use in controlling air flow into open-cell foam when the foam is under a vacuum condition.

Copending patent application Ser. No. 07/046,471, filed on May 4, 1987 by Koerber, discloses a hydraulic snub valve that incorporates a movable piston with a bypass conduit formed through the piston for the purpose of providing a bypass from the inlet of the valve to the outlet of the valve when the piston has otherwise been moved into a blocking position to stop the main flow of fluid through the valve. The function of this hydraulic snub valve is similar to the function of the present invention. It is intented to permit a full rate of fluid flow through the valve until a predetermined period of time has elapsed. After the predetermined period of time has elapsed, flow through the valve is restricted to that which can pass through the bypass conduit. This has the effect of permitting a movable object to be moved at its maximum rate of speed until the predetermined time period has elapsed and, after that occurrence, to permit a lessor flow of fluid through the valve for the purpose of moving the movable object toward its end-of-travel position at a slower speed.

SUMMARY OF THE INVENTION

The present invention is configured to control the rate of flow between a pump and a hydraulic motor. More specifically, the present invention permits full fluid flow to pass between the pump and the hydraulic motor during a portion of the travel of a movable object which is driven by the hydraulic motor between a first end-of-travel position and a second end-of-travel position. As the movable object approaches its end-of-travel positions, the rate of fluid flow through the present invention is progressively reduced so that the rate of travel of the movable object is decreased as it approaches its stop positions.

The present invention comprises first and second means for providing first and second fluid flow paths, respectively, between first and second points in the hydraulic circuit. These first and second fluid flow paths are arranged in parallel association with each other. Both the first and second fluid flow paths are provided with means for preventing fluid from flowing in one of two possible directions. In other words, fluid is only permitted to flow in a preferred direction in the first and second fluid flow paths and the preferred direction of flow in the first and second flow paths are in opposite directions relative to the first and second points in the hydraulic circuit.

Both the first and the second fluid flow paths are provided with individual means for restricting flow therethrough. The flow restricting means associated with each of the fluid flow paths is operable in response to a predetermined distance between a movable object and its end-of-travel position. Therefore, as the movable object approaches a first end-of-travel position, a first fluid flow restricting means associated with the first fluid flow path is operated to progressively reduce the amount of flow through the first fluid flow path and, as the movable object approaches a second end-of-travel position, a second restricting means associated with the second fluid flow path is operated to progressively reduce the amount of flow through the second fluid flow path. The result of the operation of these two restricting means is the reduction of the rate of travel of the movable object as it approaches either of its end-of-travel positions.

While restricting the movable object from moving at full speed against its end-of-travel, or stop, positions, the present invention permits the movable object to be moved away from its end-of-travel positions at essentially full speed. Since the first and second fluid flow paths are independent from each other, the significantly reduced flow through one of the fluid flow paths as the movable object approaches one of its end-of-travel positions does not effect the rate of flow through the other fluid flow path when the movable object is moved in a direction away from that end-of-travel position. The construction of the present invention permits the flow through each of the fluid flow paths to be reduced without similarly effecting the capability of the other fluid flow path to conduct fluid therethrough when the movable object is moved away from its end-of-travel position.

In a preferred embodiment of the present invention, a housing is provided with an internal chamber. A piston is slidably disposed within the chamber and is provided with two land portions. The chamber is provided with three openings which permit fluid to pass to and from the chamber through the housing. A first opening is connected in fluid communication with a first conduit and a second opening is connected in fluid communication with a second conduit. Both the first and second conduits are provided with a fluid flow preventing means which only permits fluid to flow through the first and second conduits in predetermined preferred directions. The first and second conduits are connected together in fluid communication at a first connection point with the first and second fluid flow preventing means being disposed in the first and second conduits between the first connection point and the chamber. The first connection point is connected in fluid communication with a pump. A third opening in the chamber is connected in fluid communication with a hydraulic motor.

A first land portion of the piston is disposed proximate the first opening and a second land portion of the piston is disposed proximate the second opening. The first land can be moved in fluid restricting association with the first opening when the piston is appropriately moved within the chamber. The second land portion of the piston can be moved in fluid restricting association with the second opening when the piston is appropriately moved within the chamber. Furthermore, when the first land is moved in fluid restricting association with the first opening, the second land is moved away from the second opening to permit full fluid flow therethrough. When the second land portion of the piston is moved in fluid restricting association with the second opening, the first land portion of the piston is moved away from the first opening to permit full fluid flow therethrough.

The first fluid flow path described above comprises the first conduit, the first fluid flow preventing means, the first opening, a portion of the chamber and the third opening. The second fluid flow path described above comprises the second conduit, the second fluid flow preventing means, the second opening through the housing to the chamber, a portion of the chamber and the third opening. Both the first and second fluid flow paths include the connection point between the first and second conduits.

The piston is operatively connected to the movable object described above. In a preferred embodiment of the present invention, a piston rod is connected to the piston and, through a gearing relationship, to the movable object. The piston rod is provided with a cam follower that is associated with a cam slot in a cam wheel. The cam wheel is rotated in association with movement of the movable object. In a preferred embodiment of the present invention, both the movable object and the cam wheel are connected in gearing relationship with a hydraulic motor.

In operation, the cam wheel rotates in response to the movement of the movable object by the hydraulic motor. As the movable object approaches an end-of-travel position, a deviation of the cam slot in the cam wheel causes the piston rod to move the piston and the piston lands within the chamber. One of the piston lands is caused to move in fluid restricting association with its associated first or second opening of the chamber. In response to this movement of the piston, either the first or second land portion of the piston is thus caused to reduce the effective cross-sectional area of its associated opening and thereby reduce the rate of fluid flow through the conduit associated with that opening. Eventually, a significant portion of the cross-sectional area of the effected opening is blocked and fluid flow through the present invention to the hydraulic motor is significantly reduced. When this occurs, the hydraulic motor slows the movement of the movable object as it reaches its end-of-travel position. Because of the fact that the other one of the first and second openings remains uneffected by this operation, full fluid flow is permitted between the pump and the hydraulic motor to move the movable object in the opposite direction of movement. Therefore, when fluid flow is commanded to flow in the opposite direction to move the movable object away from the end-of-travel position where it is located, it can be moved at essentially full speed in the direction away from the end-of-travel position because of the fact that the relevant conduit remains unrestricted in that direction of flow.

BRIEF DESCRIPTION OF THE DRAWING

The present invention may be more fully understood from a reading of the description of the preferred embodiment in conjunction with the drawing, in which.

DESCRIPTION OF THE PREFERRED EMBODIMENT

Figure 1:
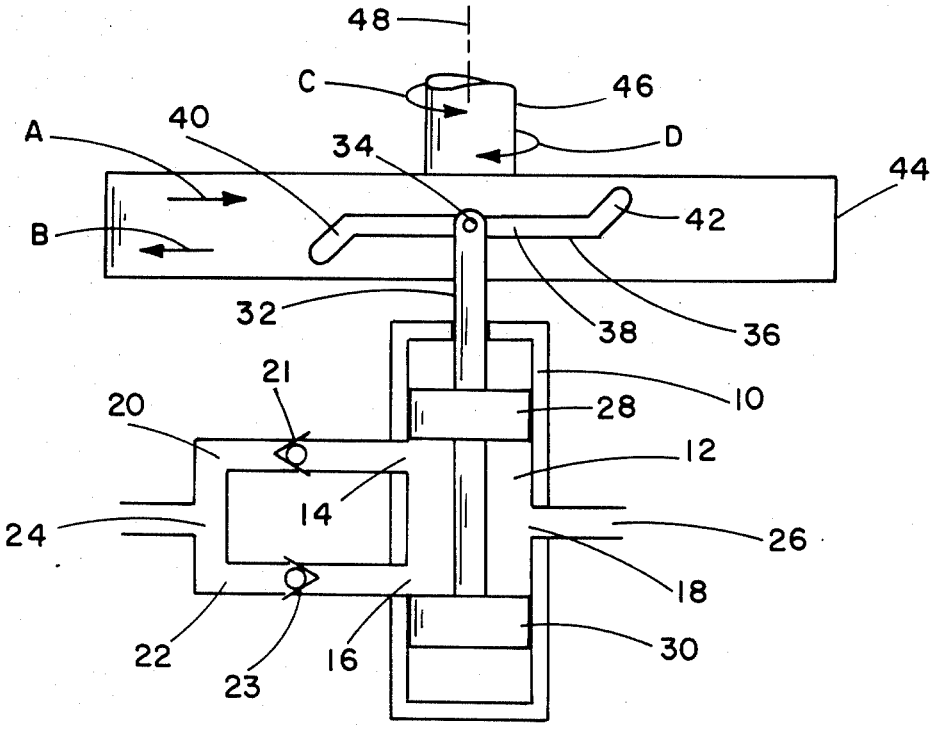
FIG. 1 illustrates the present invention in a neutral position.

FIG. 1 illustrates the present invention disposed in a neutral position. A housing 10 is provided with a chamber 12 disposed therein. The chamber 12 has a first opening 14, a second opening 16 and a third opening 18 extending from the chamber 12 through the housing 10. A first conduit 20 is connected in fluid communication with the first opening 14 and a second conduit 22 is connected in fluid communication with the second opening 16. The first conduit 20 is provided with a means for preventing fluid flow through it in one direction. As shown in FIG. 1, a preferred embodiment of the present invention provides a first check valve 21 in the first conduit 20 to prevent fluid from flowing in a direction from the chamber 12 through the first conduit 20. Similarly, the second conduit 22 is provided with a means for preventing fluid from flowing through the second conduit 22 to the chamber 12. In a preferred embodiment of the present invention, this second preventing means is provided by a second check valve 23 as shown in FIG. 1. The first 20 and second 22 conduits are joined at a first connection point 24. Both the first and second conduits are connected in fluid communication with the first connection point 24. As can also be seen in FIG. 1, the parallel association of the first 20 and second 22 conduits with the first check valve 21 and the second check valve 22 disposed as shown provides parallel fluid flow paths between the first connection point 24 and the chamber 12 in which the fluid is permitted to flow in only one preferred direction in each of the first and second conduits and these preferred directions of fluid flow are in opposite directions. In other words, fluid is permitted to flow from the first connection point 24 through the first conduit 20 and into the chamber 12 or, alternatively, from the chamber 12 through the second conduit 22 to the first connection point 24. However, fluid is prevented from flowing from the chamber 12 to the first connection point 24 through the first conduit 20 because of the presence of the first check valve 21 and, similarly, fluid is prevented from flowing from the first connection point 24 to the chamber 12 through the second conduit 22 because of the presence of the second check valve 23. A third conduit 26 is connected in fluid communication with the third opening 18.

A piston is disposed in slidable association within the chamber 12. This piston comprises a first land portion 28 and a second land portion 30 as shown in FIG. 1. Connected to the piston is a piston rod 32 which is provided with a cam follower which is indicated by reference numeral 34 in FIG. 1. It should be understood that the cam follower is actually disposed under the piston rod 32 in FIG. 1 and, as such, is not visible in the illustration. However, reference numeral 34 indicates a point where the cam follower and the piston rod 32 are connected and, for purposes of describing the present invention, the cam follower will be referred to herein by reference numeral 34.

The cam follower 34 is disposed in a cam slot 36. As can be seen in FIG. 1, the cam slot 36 comprises a generally straight segment 38 and two deviations, 40 and 42, located at the ends of the straight segment 38. The cam slot 36 is formed in a cam wheel 44 which is attached to a shaft 46 for rotation about a centerline 48.

As the cam wheel 44 is rotated about the centerline 48, the cam slot 36 will be moved in one of two alternate directions represented by arrows A and B. It should be apparent that if the shaft 46 is rotated about the centerline 48 in a direction indicated by arrow C, the cam slot 36 will move in a direction indicated by arrow A and, conversely, if the shaft 46 is rotated about the centerline 48 in a direction indicated by arrow D, the cam slot 36 will move in a direction indicated by arrow B.

If the cam slot 36 is moved in a direction indicated by arrow A, the cam follower 34 will eventually be disposed in the deviation portion 40 of the cam slot 36. This will cause the cam follower 34 to move downward in FIG. 1 and this movement will cause the first 28 and second 30 land portions of the piston to move downward within the chamber 12. Conversely, if the cam slot 36 is moved in a direction indicated by arrow B, the cam follower 34 will eventually be disposed in the deviation 42 of the cam slot 36 and will be caused to move upward in FIG. 1. This motion will cause the piston rod 32 to move upward along with the first 28 and second 30 land portions. The movements of the piston within the chamber 12 which result from the cam follower 34 being disposed in either of the deviations, 40 and 42, of the cam slot 36 will be described in greater detail below in relation to FIGS. 2 and 3.

Figure 2:
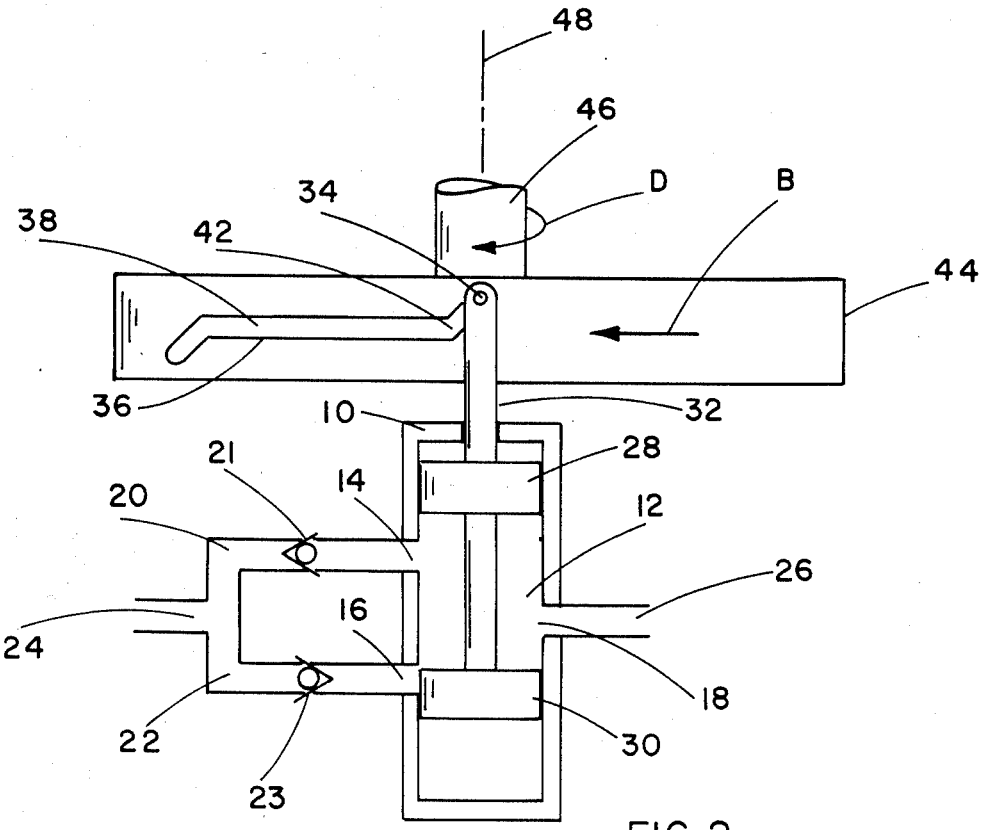
FIG. 2 illustrates the present invention disposed in one extreme limit of travel.

FIG. 2 illustrates the configuration of the present invention that results from a movement of the cam slot 36 in the direction indicated by arrow B due to the rotation of the shaft 46 around its centerline 48 in a direction indicated by arrow D. As can be seen in FIG. 2, the cam follower 34 is disposed in the deviation 42 of the cam slot 36 and, as a result, the piston rod 32 is moved upward in the figure. This upward movement of the piston rod 32 causes the first land portion 28 and the second land portion 30 to move upward within the chamber 12. Although this upward movement of the piston does not effect the first, opening 14, it causes the second land portion 30 to partially block the second opening 16. This partial blockage of the second opening 16 significantly restricts fluid from flowing in a direction from the third conduit 26 through the third opening 18 and the second opening 16 into the second conduit 22. It should be apparent that, as the second land 30 moved from its position shown in FIG. 1 to its position shown in FIG. 2, the second opening 16 is progressively blocked as a function of the position of the cam follower 34 within the deviation 42. In other words, as the cam follower 34 moves from the straight portion 38 of the cam slot 36 into the deviation portion 42 of the cam slot 36, the second land portion 30 of the piston is progressively moved upwards in FIG. 2 into a blocking position as shown. Between the position shown in FIG. 1 and the subsequent position shown in FIG. 2, the second land portion 30 progressively blocks increasing portions of the second opening 16 and, as a result, progressively reduces the flow through the second conduit 22. Eventually, as the second land 30 reached the position shown in FIG. 2, the flow through the second conduit 22 is significantly reduced. It should be noted that the second land portion 30 does not completely block the second opening 16 in a preferred embodiment of the present invention when the cam follower 34 is disposed within the deviation 42. Instead, a small portion of the second opening 16 remains open so that a small rate of fluid flow is permitted to pass from the third conduit 26 into the second conduit 22. The reason for this small opening remaining unblocked is that in manY applications it is desirable to provide a minimal oil flow as the movable object approaches its end-of-travel position. However, the rate of travel of the movable object is severly reduced so that, as the movable object approaches the stops at its end-of-travel positions, potential damage is avoided.

As can also be seen in FIG. 2, flow from the third conduit 26 to the first connection point 24 is prevented by the check valve 21 in the first conduit 20 and the position of the second land portion 30 relative to the second opening 16. Therefore, if the pressure in the third conduit 26 is greater than the pressure at the first connection point 24, only a very small amount of fluid flow would be permitted through the present invention. However, it should be noted that fluid flow is permitted through the present invention if the fluid pressure at the first connection point 24 becomes greater than the fluid pressure at the third conduit 26. When this occurs, fluid is freely permitted to pass from the first connection point 24, through the first conduit 20 and first check valve 21, through the chamber 12 and the third opening 18 into the third conduit 26. As a result, the direction of fluid flow through the present invention is permitted to be reversed from the direction which caused the second land portion 30 to move into blocking association with the second opening 16. The presence of the second land portion 30 relative to the second opening 16 therefore has not effect on the flow through the first conduit 20.

Figure 3:
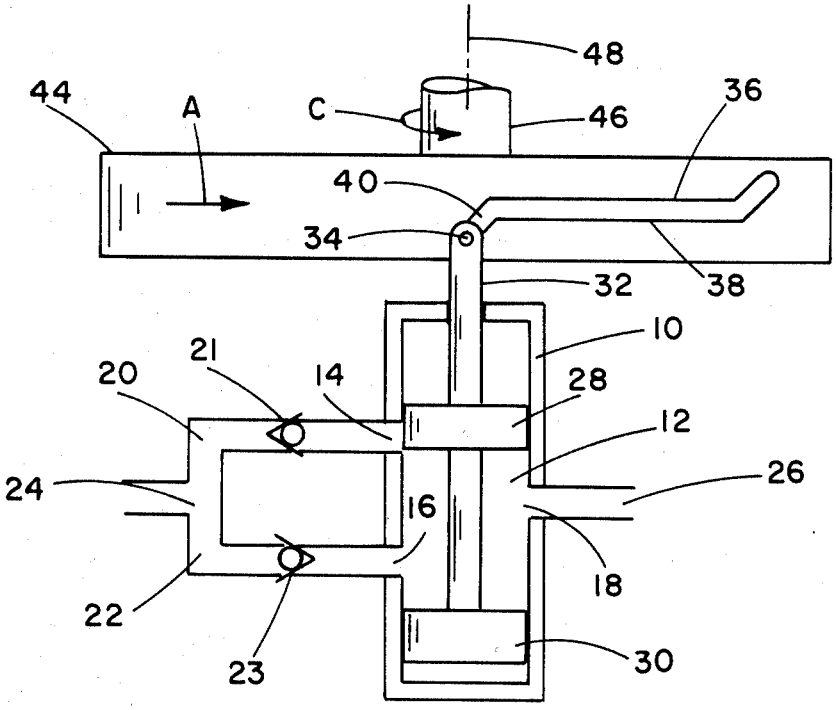
FIG. 3 illustrates the present invention disposed in another extreme limit of travel opposite to that shown in FIG. 2.

FIG. 3 illustrates the present invention at its extreme end-of-travel position which is opposite to that shown in FIG. 2. When the shaft 46 rotates in a direction around its centerline 48 indicated by arrow C, the cam slot 36 moves in a direction indicated by arrow A because of the rotation of the cam wheel 44. This movement of the cam slot 36 disposes the cam follower 34 in the deviation 40 of the cam slot. When the cam follower 34 is thus disposed in the deviation 40 of the cam slot, the piston rod 32 is moved in a downward direction in FIG. 3 and the first land portion 28 of the piston is progressively moved into a blocking relationship with the first opening 14. This movement of the first land portion 28 significantly reduces the flow of fluid flowing through the first conduit 20 in a direction from the first connection point 24 toward the chamber 12 and the third conduit 26. Fluid flow in this same direction through the second conduit 22 is prevented by the check valve 23. Therefore, when the first land portion 28 is disposed in the position illustrated in FIG. 3, only a very small amount of fluid flow is permitted to pass from the first connection point 24 through the first conduit 20 and the chamber 12 toward the third conduit 26. It should be understood that, as the cam follower 34 moved from the straight portion 38 of the cam slot 36 into the deviation 40 of the cam slot 36, the first land portion 28 progressively moved into a fluid flow blocking relationship with the first opening 14. As the first land portion 28 progressively moved into the position shown in FIG. 3, flow through the first conduit 20 and the first opening 14 was progressively reduced from a full flow condition to a significantly reduced flow condition. It should be noted that, as described above in relation to the second land portion 28 and the second opening 16, the first land portion 28 does not completely block the first opening 14 in a preferred embodiment of the present invention even when the piston is moved to its extreme position when the cam follower 34 is in the deviation 40. Instead, the first opening 14 remains partially opened to permit a significantly reduced amount of fluid to flow through the present invention from the first connection point 24 towards the third conduit 26. As described above, the reason for this partial opening is to permit a reduced rate of fluid flow through the present invention so that the movable object will be moved to its stop position but at a significantly reduced rate of speed so as to prevent damage from occurring when the movable object is moved into contact with the stop at the end-of-travel position.

Referring to FIG. 3, it should be understood that if the fluid pressure at the first connection point 24 is higher than the fluid pressure in the third conduit 26, only a very small fluid flow will be permitted through the present invention. This fluid flow is significantly reduced because the first opening 14 is blocked by the first land portion 28 and the second check valve 23 prevents fluid from flowing through the second conduit 22. However, it should be understood that, if the fluid pressure in the third conduit 26 becomes greater than the fluid pressure at the first connection point 24, fluid is free to flow from the third conduit 26 through the third opening 18 and the chamber 12 into the second conduit 22 through the second opening 16. Therefore, although the presence of the first land portion 28 of the piston essentially prevents movement which would cause the cam slot 36 to move in the direction indicated by arrow A, it permits movement in the opposite direction.

Figure 4:
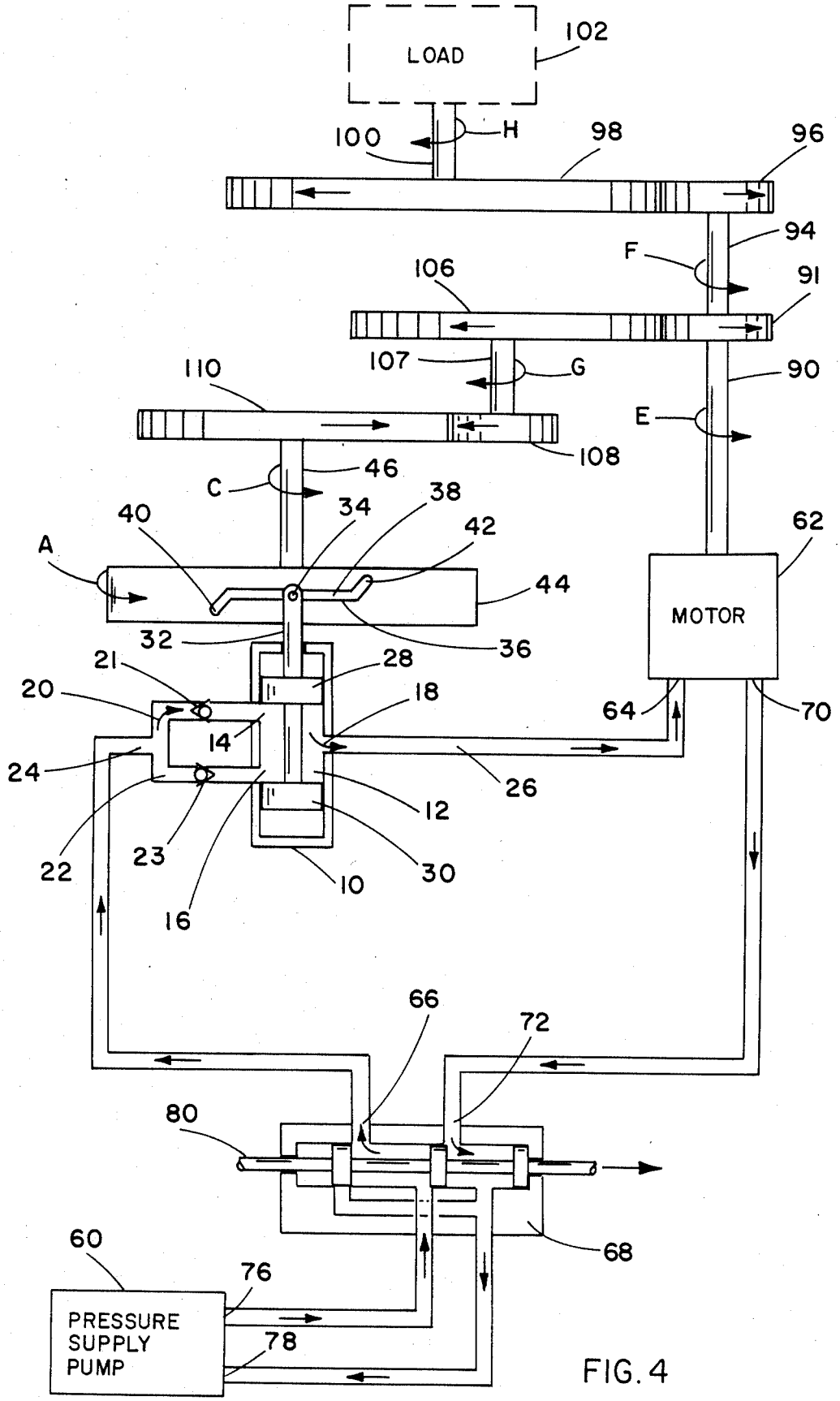
FIG. 4 illustrates the present invention associated with a hydraulic motor, a pressure supply pump and a directional control valve to depict one fluid flow arrangement for movement of a movable object in a preselected direction.
Figure 5:
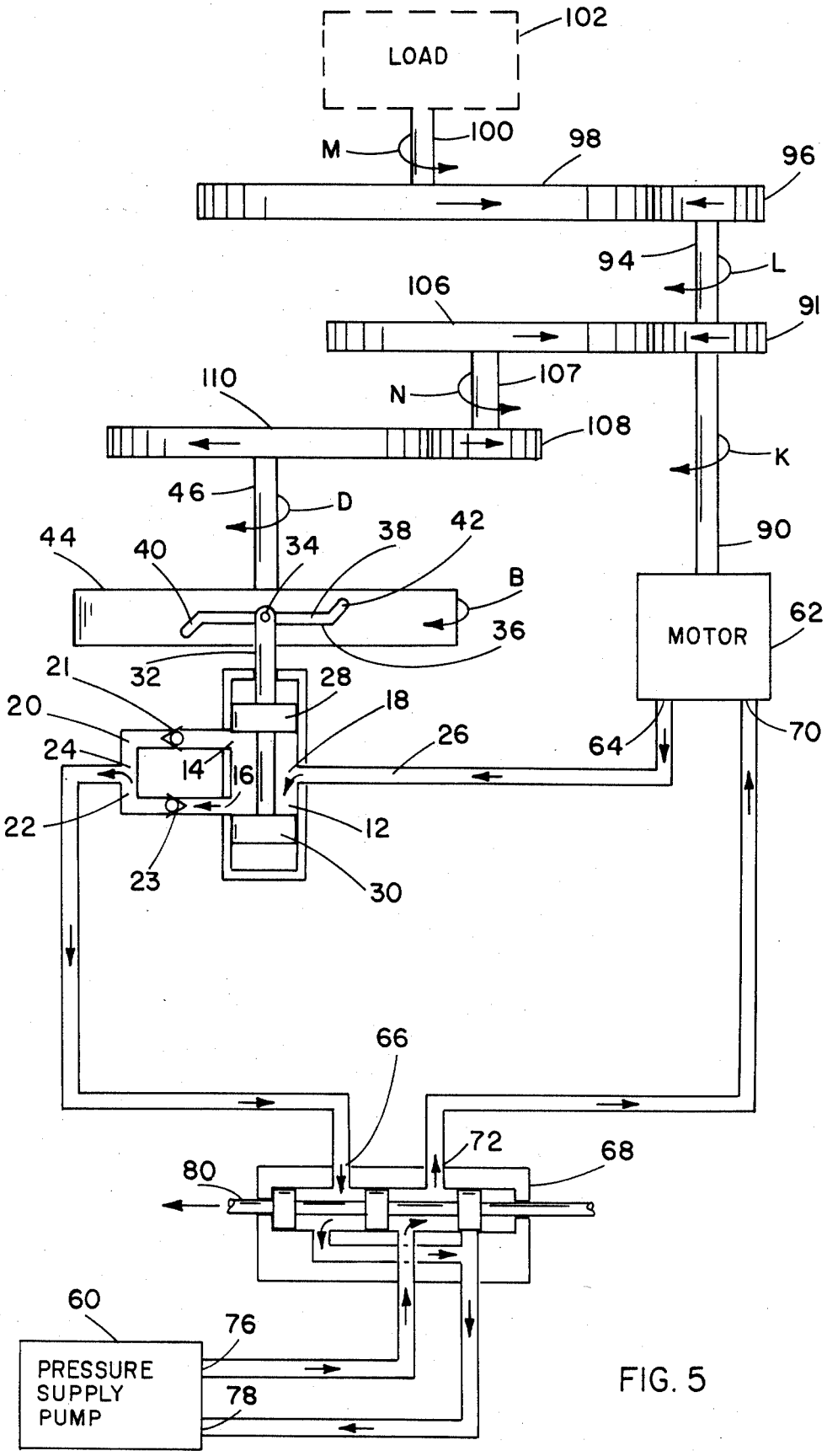
FIG. 5 illustrates the arrangement shown in FIG. 4 but with an opposite direction of fluid flow travel for moving the movable object in an opposite direction to that shown in FIG. 4.

FIG. 4 is a schematic illustration of the present invention used in conjunction with a pressure supply pump 60 and a hydraulic motor 62. The third conduit 26 of the present invention is connected in fluid communication with a first port 64 of the hydraulic motor 62. Furthermore, the first connection point 24 of the present invention is connected in fluid communication with a first passage 66 of a directional control valve 68. A second port 70 of the hydraulic motor 62 is connected in fluid communication with a second passage 72 of the directional control valve 68. A pressure supply pump 60 is provided with an outlet 76 and an inlet return passage 78. The directional control valve 68, which is well known to those skilled in the art, is configured to connect its first passage 66 to either the outlet 76 or the inlet 78 of the pressure supply pump 60 and, alternatively, to connect its second passage 72 to either the outlet 76 or the inlet 78 of the pressure supply pump 60. An actuator 80 of the directional control valve 68 can be moved to the position shown in FIG. 4 to connect the outlet 76 of the pressure supply pump 60 to the first passage 66 and to connect the inlet 78 of the pressure supply pump 60 to the second passage 72 or, as shown in FIG. 5, to connect the outlet 76 of the pressure supply pump 60 to the second passage 72 and the inlet 78 of the pressure supply pump 60 to the first passage 66. In other words, the directional control valve 68, in a manner well known to those skilled in the art, can be used to connect the outlet 76 of the pressure supply pump 60 in fluid communication with either the first connection point 24 of the present invention or, alternatively, to connect the outlet 76 of the pressure supply pump 60 in fluid communication with the second port 70 of the hydraulic motor and to connect the inlet 78 of the pressure supply pump 60 to the first connection point 24 of the present invention. As will be described in greater detail below, the position of the directional control valve 68 will determine the direction of rotation of the reversible hydraulic motor 62.

As shown in FIG. 4, the hydraulic motor 62 is configured to rotate a motor shaft 90 in either a clockwise or a counter-clockwise direction. For purposes of this illustration, it will be assumed that when pressure is provided to cause fluid to flow from the third conduit 26 to the first port 64 of the hydraulic motor 62, the motor shaft 90 will rotate in a direction indicated by arrow E. This rotation will cause a first gear 91 to rotate in a direction indicated by its arrow. Since shaft 94 is rigidly connected to both the motor shaft 90 and the first gear 91, it will rotate in the direction indicated by arrow F and a second gear 96, which is rigidly attached to the shaft 94 will rotate as indicated by its arrow. Since the third gear 98 is connected in meshing relation with the second gear 96, it will rotate as indicated by its arrow and its shaft 100 will rotate in the direction indicated by arrow H.

A load, indicated by reference numeral 102, is thus caused to move in a predetermined direction by the motion of the motor shaft 90 and the gearing relationship between the hydraulic motor 62 and shaft 100. It should be understood that the load 102 can be an aircraft control surface or any other movable object, such as a door. It should also be understood that the load 102, indicated by a dashed box, can be virtually any type of movable object and, as such, its specific construction is not directly relevant to the operation or description of the present invention. The load 102 is configured to move in either of two directions. These directions can be the opening direction and closing direction of a door or, alternatively, opposite directions of movement of an aircraft control surface caused by clockwise and counter-clockwise rotation of the control surface about a centerline of rotation.

Since a fourth gear 106 is connected in meshing relation with the first gear 91, it will rotate in a direction indicated by its arrow and its shaft 107 will rotate in the direction indicated by arrow G. Furthermore, since a fifth gear 108 is connected to the fourth gear 106 by shaft 107, it will rotate in the direction indicated by its arrow. The sixth gear 110 is connected in meshing relation with the fifth gear 108 and will therefore rotate in the direction indicated by its arrow along with shaft 46, which is rigidly attached to the sixth gear 110. The shaft 46 will therefore be caused to rotate in the direction indicated by arrow C and, as a result of its connection to shaft 46, the cam wheel 44 will be caused to rotate in the direction indicated by arrow A.

As described above, the cam wheel 44 is attached to shaft 46 and rotates with it. It should therefore be apparent that movement of the shaft motor 90 will cause the load 102 to move in a predetermined direction and will also cause the cam wheel 44 to move in a predetermined direction which is associated with the direction of movement of the movable object, or load 102. It should also be apparent that, by the appropriate choice of gearing ratios, the movement of the cam slot 36 can be made to conform according to a preselected relationship to the movement of the load 102.

The operation of the present invention will be described in conjunction with the system shown in FIG. 4. With the direction control valve 68 in the position shown in FIG. 4, fluid will flow from the output 76 of the pressure supply pump 60 through the direction control valve 68 and out of the first passage 66. The fluid will then flow to the first connection point 24 of the present invention. Since the second check valve 23 will prevent fluid from flowing through the second conduit 22, the fluid is limited to flow through the first conduit 20 and the first check valve 21 in the direction shown by the arrows. With the piston of the present invention in the position shown in FIG. 4, the fluid is free to flow through the first opening 14, the chamber 12 and the third opening 18 into the third conduit 26. From the third conduit 26, the fluid can then flow to the first port 64 of the hydraulic motor 66 and thereby cause the hydraulic motor 66 to rotate its motor shaft 90 in the direction shown by arrow E. All of the gears shown in FIG. 4 will rotate in the directions indicated by their respective arrows and the load 102 will move in a predetermined direction.

The fluid returns from the hydraulic motor 62, out of its second port 70, to the second passage 72 of the direction control valve 68. After passing through the direction control valve 68, the fluid returns to the inlet 78 of the pressure supply pump.

As the motor shaft 90 continues to rotate in the direction indicated by arrow E, the load 102 continues to move in its predetermined direction and the cam wheel 44 continues to rotate in the direction indicated by arrow A because of the relationships of the gears and shafts which are described above. This causes the cam slot 36 to move towards the right of FIG. 4 and, eventually, the cam follower 34 will be disposed in the deviation 40 of the cam slot 36. As the cam follower 34 enters the region where the straight segment 38 joins the deviation 40, it will begin to move in a downward direction in FIG. 4. This downward movement of the cam follower 34 will cause the piston rod 32 to begin to move downward and, eventually, the first land portion 28 of the piston will begin to block a portion of the first opening 14. As the effective area of the first opening 14 begins to be blocked, the fluid flow through the first conduit 20 will gradually be reduced and, as a result of this reduced flow, the speed of the hydraulic motor 62 will correspondingly be reduced. This reduction of flow through the first conduit 20 and the first port 64 of the hydraulic motor 62 will cause the rate of movement of the load 102 to be reduced. Eventually, as the cam follower 34 is disposed at the extreme end of the deviation 40, the first land portion 28 of the piston will be disposed in significant blocking association with the first opening 14. This position, which is shown in FIG. 3 and described above, significantly restricts the fluid flowing from the first connection point 24 through the first conduit 20 and toward the hydraulic motor 62 through the third conduit 26. The blockage of the first opening 14 will significantly reduce the flow of fluid to the hydraulic motor 62 and, as a result, the rate of movement of the load 102 will be significantly slowed as it approaches its end-of-travel position. It should be apparent that the movement of the load 102 was progressively slowed as the first land portion 28 of the present invention began to block the first opening 14. Subsequently, as the first land portion 28 moved in increasingly blocking association with the first opening 14, the flow of fluid through the present invention was further decreased until, when the first land portion 28 significantly blocked the first opening 14, the flow of fluid was reduced to a very small rate.

It should be apparent that the position of the first land portion 28 in blocking relation with the first opening 14 does not effect the second opening 16. Therefore, if the direction control valve 68 is reversed at a time when the cam follower 34 is at the extreme distal end portion of the deviation 40 and the first land portion 28 is blocking the first opening 14, fluid will be permitted to flow freely from the first port 64 of the hydraulic motor 62, through the third conduit 26, the second check valve 23, the second conduit 22 and the first connection point 24. Therefore, even though the present invention significantly inhibits fluid from flowing in the direction indicated by the arrows in FIG. 4, it does not inhibit a reversal of fluid flow to move the load 102 in a direction opposite to that which caused the cam follower 34 to reach the distal end of the deviation 40. This characteristic is significantly advantageous in many applications because, although the present invention slows the rate of travel as the movable object approaches its end-of-travel, it permits that movable object, or load 102, to be moved rapidly away from that end-of-travel position. For example, if the load 102 is a door that is hydraulically controlled, the present invention could be implemented to permit the door to move from a completely opened position to a partially closed position at a rapid rate of travel and then move more slowly as the door approaches a fully closed position. However, after the door is completely closed, the present invention permits the door to be moved from its completely closed position to an opened position at a full rate of speed without any reduction being caused by the present invention.

FIG. 5 illustrates the present invention connected in association with the pressure supply pump 60 and the hydraulic motor 62, but with the actuator 80 of the direction control valve 68 configured to reverse the direction of flow compared with the direction of flow shown in FIG. 4. With the direction control valve 68 in the position shown in FIG. 5, fluid flows from the first Port 64 of the motor 62 toward the present invention and from the first connection point 24 of the present invention toward the first passage 66 of the direction control valve. Although the direction of flow in FIG. 5 is opposite to that shown in FIG. 4, it should be understood that the direction of flow from the pressure supply pump 60 is the same. For example, fluid will flow from the outlet 76 of the pressure supply pump 60 and be returned to its inlet 78. The direction control valve 68 permits the pressure supply pump 60 to work in this manner while the direction of flow through the hydraulic motor 68 and the present invention is reversed.

With the direction of rotation of the hydraulic motor 62 reversed, the motor shaft 90 rotates in a direction opposite to that shown by arrow E in FIG. 4 and, instead, in the direction shown by arrow K in FIG. 5. This causes the first gear 91 to rotate in the direction indicated by its arrow and the shaft 94, which is rigidly attached to both the first 91 and second 96 gears, to rotate in the direction indicated by arrow L. The second gear 96 rotates in the direction shown by its arrow and, because it is connected in meshing relation with the second gear, the third gear 98 rotates in the direction indicated by its arrow and the shaft 100, which is rigidly connected to the third gear 98, rotates in the direction indicated by arrow M. This causes the load 102 to rotate or move in a predetermined direction which is opposite to the direction resulting from the movement of the components indicated in FIG. 4. Thus, by reversing the rotation of the hydraulic motor 62, the movement of the load 102 is reversed. It should be understood that the load 102 can be any movable object as described above, such as a door or an aircraft control surface. With the shaft 90 rotating in the direction indicated by arrow K, the fourth gear 106 will move in the direction indicated by its arrow because of the meshing relationship between the first gear 91 and the fourth gear 106. This causes shaft 107 to rotate in the direction indicated by arrow N and the fifth gear 108 to rotate in the direction indicated by its arrow. The meshing relationship between the fifth gear 108 and the sixth gear 100 causes the sixth gear 100 to rotate in the direction indicated by its arrow which, in turn, causes shaft 46 to rotate in the direction indicated by arrow D. Therefore, it should be apparent that the cam wheel 44 will rotate in the direction indicated by arrow B and the cam slot 36 will move toward the left portion of FIG. 5.

As the cam slot 36 moves to the left of FIG. 5, the cam follower 34 will eventually move from the straight portion 38 of the cam slot 36 into the deviation 42. This movement of the cam follower 34 into the deviation 42, will cause the piston rod 32 to move upward in FIG. 5. This upward movement of the piston rod 32 will raise both the first 28 and second 30 land portions of the piston. As the second land portion 30 moves upward, it will begin to block a portion of the second opening 16. As this occurs, fluid flow from the motor 62 through the present invention to the first connection point 24 will be decreased because of the reduced effective cross-section of the second opening 16. As the second land portion 30 continues to move upward in FIG. 5, it will progressively block increasing portions of the second opening 16 and, eventually, will significantly restrict the flow through the second opening 16. This will occur when the cam follower 34 is at the extreme end portion of the deviation 42. When the hydraulic motor 62 is thus significantly deprived of fluid flow, the motor shaft 90 will significantly slow its rotation and the load 102 will slowly approach the stop at its end-of-travel position. It should be noted that the blockage of the second opening 16 by the second land portion 30 does not effect the first opening 14. Therefore, when the load 102 is at its extreme end-of-travel position and the cam follower 34 is at the extreme distal end of the deviation 42, fluid will be permitted to flow through the first conduit 20 in a direction from the first connection point 24 toward the third conduit 26 and the first port 64 of the motor 62. This permits the movement of the load 102 to be reversed in a way that moves it at full speed away from its end-of-travel position.

Referring to FIGS. 4 and 5, it should be apparent that the present invention permits fluid to flow in either of two directions through its chamber 12. Furthermore, the present invention provides two parallel fluid flow paths between its chamber 12 and a first connection point 24. These parallel paths are each provided with a means for restricting flow through the paths to one preferred direction. In other words, the check valves, 21 and 23, permit flow in only one direction through the first conduit 20 and the second conduit 22 and these preferred directions of flow are in opposite directions. Furthermore, the present invention provides a first land portion 28 and a second land portion 30 which can be selectively moved into blocking association with the first opening 14 and second opening 16. Most significantly, the blockage of either the first opening 14 or second opening 16 by its associated land portion does not effect the other opening and its ability to conduct fluid in a direction suitable to move a movable object, such as the load 102, in a direction away from its stop position at its end-of-travel.

Figure 6:
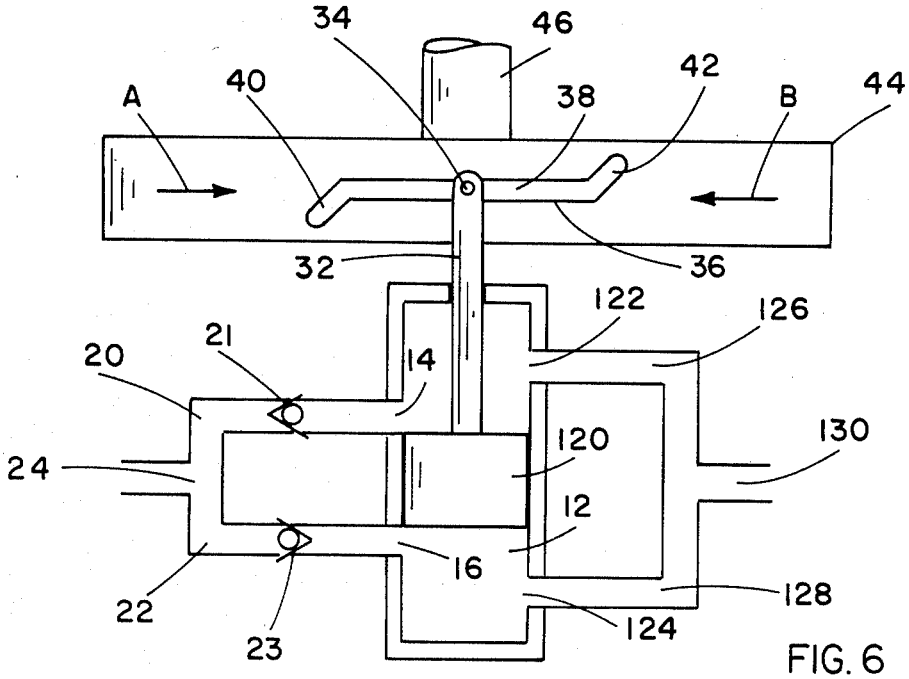
FIG. 6 illustrates an alternative embodiment of the present invention.

FIG. 6 illustrates an alternative embodiment of the present invention. The embodiment of the present invention illustrated in FIG. 6 differs from the embodiment illustrated in FIG. 1 in two significant ways. First, a single land 120 is provided by the piston. Also, the third conduit 26 and the third opening 18, which are illustrated in FIG. 1, are replaced by a fourth opening 122 and a fifth opening 124 which are connected, respectively, to a fourth conduit 126 and a fifth conduit 128. The fourth and fifth conduits are connected in fluid communication with each other at a second connection point 130. This second connection point 130 can be connected to the hydraulic motor 62 which is shown in FIGS. 4 and 5. The embodiment of the present invention shown in FIG. 6 could be connected between a hydraulic motor and a pressure supply pump in a manner that is similar to the way that the preferred embodiment of the present invention is connected as shown in FIGS. 4 and 5.

The operation of the alternative embodiment of the present invention shown in FIG. 6 is as follows. When the cam wheel 44 moves in a direction indicated by arrow A, the cam follower 34 moves into the deviation portion 40 of the cam slot 36 and the piston rod 32 is moved downward. This significantly blocks the second opening 16 in a manner similar to the way that the second land portion 30 block the second opening 16 in the description above relating to the preferred embodiment of the present invention. Even though the second opening 16 is significantly blocked by the land 120, fluid is permitted to flow in a direction from the first connection point 24 through the first conduit 20 and the chamber 12 into the fourth opening 122, the fourth conduit 126 and toward the second connection point 130 and the hydraulic pump (not shown in FIG. 6). Therefore, the feature of the preferred embodiment of the present invention which permits the movable object to be moved rapidly away from its end-of-travel position is also provided by the alternative embodiment illustrated in FIG. 6. When the movable object is moved in an opposite direction, the cam wheel 44 is caused to move in the direction indicated by arrow B. In other words, the cam follower 34 moves out of the deviation portion 40 of the cam slot 36 and into the generally straight portion 38 of the cam slot 36. This movement causes the land portion 120 to move away from blocking relationship with the second opening 16. As the cam wheel 44 continues to rotate, the cam follower 34 is moved into position within the deviation portion 42 of the cam slot 36 and the piston rod 32 is moved in an upward direction in FIG. 6. This causes the land 120 to initially begin to reduce the effective cross-sectional area of the first opening 14 and, eventually, to significantly block the first opening 14. This progressive reduction in flow through the first conduit 20 causes the movement of the movable object to initially be slowed as it approaches its end-of-travel position and, eventually, to be significantly slowed as it reaches its end-of-travel position. As described above, the association of the land portion 120 in significant blocking relationship with the first opening 14 does not effect the ability of the second conduit 22 to conduct a flow of fluid therethrough. Therefore, the alternative embodiment of the present invention illustrated in FIG. 6 permits a full rate of fluid to flow through the second conduit 22 and cause the movable object to move away from its end-of-travel position at a full rate of speed limited only by the ability of the pump and hydraulic motor used in conjunction with the present invention.

Although the present invention has been illustrated with considerable detail and a preferred and alternative embodiment of the present invention has been specifically described, it should be understood that other alternative embodiments not discussed above are also possible within the scope of the present invention.

What I claim is:

1. A valve, comprising:

first means for providing a first fluid flow path between a first conduit and a second conduit;

second means for providing a second fluid flow path between said first conduit and said second conduit, said first and second fluid flow path providing means being arranged in parallel association with each other between said first and second conduits;

first means for preventing fluid from flowing in a direction opposite to a first preferred direction of flow in said first fluid flow path, said first fluid flow path being the only fluid flow path between said first conduit and said second conduit in said first preferred direction through said valve;

second means for preventing fluid from flowing in a direction opposite to a second preferred direction of flow in said second fluid flow path, said second fluid flow path being the only fluid flow path between said second conduit and said first conduit in said second preferred direction through said valve, said first and second preferred directions being opposite to each other;

first means for restricting fluid flow in said first preferred direction in said first fluid flow path providing means as a function of the distance of movable object from a first position; and second means for restricting fluid flow in said second preferred direction in said second fluid flow path providing means as a function of the distance of said movable object from a second position.

2. The valve of claim 1, wherein:

said first preventing means is a first check valve.

3. The valve of claim 1, wherein:

said second preventing means is a second check valve.

4. The valve of claim 1, wherein:

said first restricting means comprises a first land slidably disposed in a cylinder, said first land being disposed to progressively restrict said first fluid flow path in response to movement of said first land in said cylinder.

5. The valve of claim 1, wherein:

said second restricting means comprises a second land slidably disposed in a cylinder, said second land being disposed to progressively restrict said second fluid flow path in response to movement of said second land in said cylinder.

6. The valve of claim 1, further comprising:

means for moving said first and second restricting means in response to the position of said movable object relative to said first and second positions.

7. A valve, comprising:

first means for providing a first flow path between a pump and a hydraulic motor;

second means for providing a second flow path between said pump and said hydraulic motor, said first and second flow path providing means being arranged in parallel association with each other between said pump and said motor;

first means for preventing fluid from flowing from said hydraulic motor toward said pump through said first flow path providing means, said first flow path being the only flow path from said pump toward said hydraulic motor through said valve;

second means for preventing fluid from flowing from said pump toward said hydraulic motor through said second flow path providing means, said second flow path being the only flow path from said hydraulic motor toward said pump through said valve;

first means for reducing fluid flow from said pump toward said hydraulic motor through said first flow path providing means;

second means for reducing fluid flow from said hydraulic motor toward said pump through said second flow path providing means, said first and second reducing means being operative in response to the position of a movable object;

means for actuating said first reducing means in response to movement of said moveable object relative to a first position; and means for actuating said second reducing means in response to movement of said movable object relative to a second position.

8. The valve of claim 7, wherein:

said first preventing means comprises a first check valve and said second preventing means comprises a second check valve, said first and second check valve being arranged in parallel and in opposite polarity with each other.

9. The valve of claim 8, wherein:

said first reducing means comprises a first land of a position slidably disposed in a cylinder, said cylinder being disposed in fluid communication with said pump and said hydraulic motor.

10. The valve of claim 9, wherein:

said second reducing means comprises a second land of said piston.

11. A valve, comprising:

a housing having a chamber disposed therein, said chamber having a first opening, a second opening and a third opening through said housing;

a piston slidably disposed in said chamber, said piston comprising a first land portion and a second land portion;

a first conduit connected in fluid communication with said first opening;

a second conduit connected in fluid communication with said second opening, said first and second conduits being connected in fluid communication with each other at a first connection point external to said chamber, said first and second conduits being connected in parallel association with each other between said chamber and said first connection point;

a third conduit connected in fluid connection with said third opening;

first means for preventing fluid from flowing from said chamber toward said first connection point in said first conduit, said first conduit being the exclusive flow path from said first connection point toward said chamber through said valve;

second means for preventing fluid from flowing from said first connection point toward said chamber in said second conduit, said second conduit being the exclusive flow path from said chamber toward said first connection point through said valve, said first and second preventing means being disposed between said first connection point and said chamber; and means for moving said piston in response to movement of a movable object, said moving means being connected to said piston, said first lend being movable to a position proximate said first opening wherein the effective area of said first opening is progressively reduced, said second land being movable to a position proximate said second opening wherein the effective area of said second opening is reduced.

12. The valve of claim 11, wherein:

said chamber is generally cylindrical.

13. The valve of claim 11, wherein:

said first connection point is connected in fluid communication with a pump.

14. The valve of claim 11, wherein:

said third opening is connected in fluid communication with a hydraulic motor.

15. The valve of claim 11, wherein:

said first preventing means comprises a check valve.

16. The valve of claim 11, wherein:

said second preventing means comprises a check valve.

17. The valve of claim 11, wherein:

said piston moving means comprises a rod connected to said first and second lands, said rod having a cam following portion operatively associated with a rotary cam wheel, said cam wheel being connected in geared relation with said movable object, said rod extending through said housing.

18. A valve, comprising:

a housing having a generally cylindrical chamber disposed therein, said chamber having first, second and third openings extending through said housing;

a first conduit connected in fluid communication with said first opening;

a second conduit connected in fluid communication with said second opening, said first and second conduits being connected in fluid communication with each other at a first connection point, said first and second conduits being connected in parallel with each other;

a third conduit connected in fluid communication with said third opening;

first means for preventing fluid from flowing through said first conduit from said chamber toward said first connection point, said first conduit being the exclusive flow path from said first connection point toward said chamber through said valve;

second means for preventing fluid from flowing through said second conduit from said first connection point toward said chamber, said second conduit being the exclusive flow path from said chamber toward said first connection point through said valve;

a piston slidably disposed in said chamber, said piston having a first land portion and a second land portion; and means connected to said piston for moving said piston on relation to the position of a movable object, said moving means being connected in gearing relation with said movable object, wherein said first land is movable to a position which reduces the effective area of said first opening and second land is movable to a position which reduces the effective area of said second opening.

19. The valve of claim 18, wherein:

said first preventing means is a check valve.

20. The valve of claim 19, wherein:

said second preventing means is a check valve.

21. The valve of claim 20, wherein:

said moving means comprises a rod connected to said piston, said rod extending through said housing and having a cam follower portion, said cam follower portion being slidably associated with a groove in a cam wheel, said cam wheel being connected in gearing relation with said movable object.

22. The valve of claim 21, wherein:

said first connection point is connected in fluid communication with a pump and said third conduit is connected in fluid communication with a hydraulic motor.

23. The valve of claim 22, wherein:

said moving means is arranged to cause said first land to progressively reduce the effective area of said first opening as a function of the distance between said movable object and a first location.

24. The valve of claim 22, wherein:

said moving means is arranged to cause said second land to progressively reduce the effective area of said second opening as a function of the distance between said movable object and a second location.

* * * * *